US007239838B2

(12) United States Patent
Sato et al.

(10) Patent No.: US 7,239,838 B2
(45) Date of Patent: Jul. 3, 2007

(54) FIXING APPARATUS AND IMAGE FORMATION APPARATUS USING SAME

(75) Inventors: Masahiko Sato, Chiba (JP); Ken Omura, Tokyo (JP); Naoki Iwaya, Kanagawa (JP); Akira Shinshi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 245 days.

(21) Appl. No.: 10/991,545

(22) Filed: Nov. 19, 2004

(65) Prior Publication Data

US 2005/0129432 A1 Jun. 16, 2005

(30) Foreign Application Priority Data

Nov. 25, 2003 (JP) ..... 2003-393315

(51) Int. Cl.
*G03G 15/20* (2006.01)

(52) U.S. Cl. ..... 399/329

(58) Field of Classification Search ..... 399/320, 399/328, 329, 330, 331; 430/106.2; 219/216
See application file for complete search history.

(56) References Cited

U.S. PATENT DOCUMENTS

| | | | |
|---|---|---|---|
| 5,300,996 | A | 4/1994 | Yokoyama et al. |
| 5,400,123 | A | 3/1995 | Sato et al. |
| 5,832,354 | A | 11/1998 | Kouno et al. |
| RE36,124 | E | 3/1999 | Yokoyama et al. |
| 5,915,147 | A | 6/1999 | Kouno et al. |
| 5,970,298 | A | 10/1999 | Seki et al. |

(Continued)

FOREIGN PATENT DOCUMENTS

| | | | |
|---|---|---|---|
| JP | 2001-209266 | | 8/2001 |
| JP | 2002-251089 | | 9/2002 |
| JP | 2003-122179 | * | 4/2003 |

OTHER PUBLICATIONS

U.S. Appl. No. 11/521,472, filed Sep. 15, 2006, Shinshi, et al.
U.S. Appl. No. 11/519,007, filed Sep. 12, 2006, Shinshi, et al.
U.S. Appl. No. 10/586,399, filed Jul. 17, 2006, Satoh, et al.

*Primary Examiner*—Hoan Tran
(74) *Attorney, Agent, or Firm*—Oblon, Spivak, McClelland, Maier & Neustadt, P.C.

(57) ABSTRACT

It is an object of the present invention to provide a fixing apparatus with which the movement of heat to the fixing belt during warm-up is suppressed, and the time it takes for the heating roller temperature to rise can be shortened, by reducing the contact surface area between the fixing belt and the heating roller, and an image formation apparatus that makes use of this fixing apparatus, and a toner used therein. A separation member provided on the inside of the fixing belt forms a pair with a tension roller, and a switching device for switching the positions thereof switches the positions when a set temperature is detected by temperature sensing device installed on the heating roller, so that the contact surface area of the fixing belt on the heating roller is different during warm-up and during fixing.

26 Claims, 6 Drawing Sheets

U.S. PATENT DOCUMENTS 6,305,636 B1 10/2001 Satoh et al.
6,596,452 B2 * 7/2003 Magome et al. ..... 430/106.2
6,658,230 B2 12/2003 Satoh
6,771,925 B2 8/2004 Satoh
2004/0013453 A1 1/2004 Shinshi et al.
2005/0129432 A1 6/2005 Sato et al.

* cited by examiner

FIXING APPARATUS AND IMAGE FORMATION APPARATUS USING SAME

BACKGROUND OF THE INVENTION

1. Field of the Invention

The present invention relates to an image formation apparatus such as a copier, fax machine, or printer, and more particularly relates to a fixing apparatus that melts and solidifies toner on a recording medium such as recording paper or OHP film.

2. Description of the Related Art

In the fixing step with this type of image formation apparatus, a toner image on a recording medium that has been transferred from a photosensitive member (latent image support) is fixed on a recording medium, and this is an essential step in which, for example, toner is put in a molten state by heating and pressing, and the toner is made to permeate and fuse to transfer paper, a resin sheet, or another such recording medium in this molten state. Fixing methods include contact fixing methods in which the members on the heat source side are in direct contact with the toner (what is being fixed), and non-contact methods which involve atmospheric heating by ultraviolet rays or inductive heating. Typical contact fixing methods are heat roller fixing methods and belt fixing methods. With the fixing apparatus used in all of these contact methods, a nip is formed at a location where there is contact with the roller and/or belt, the recording medium is conveyed so as to be heated and pressed in this nip, and this fixes the toner to the recording medium. The heating and pressing are accomplished by bringing the toner into direct contact with a heated belt or a fixing roller equipped with an internal heat source such as a halogen lamp or a nichrome wire, thereby fixing the toner. With this fixing apparatus, the heat source is managed by a temperature sensor provided to the roller or belt surface so that the surface is kept at a specific temperature, and this stabilizes the amount of heat supplied to the sheet passing through the nip.

There has been demand in recent years for lower energy consumption and shorter standby times. However, if the temperature during standby is lowered, it takes longer for warm-up, which is how long it takes for the fixing apparatus to rise to the temperature at which fixing is possible, and this lowers fixing efficiency. Consequently, in an effort to reduce the thermal capacity of a fixing apparatus, fixing belts have come to be used rather than a fixing roller. Switching to a fixing belt speeds up the rise in temperature of the fixing apparatus, which shortens the warm-up time and helps conserve energy. With a fixing apparatus equipped with a fixing belt, the heating roller is warmed by heat generated from a heater or the like, and this heat is transmitted to the belt, which supplies heat to the nip where the unfixed toner image is fixed.

When a thin heating roller is used in order to speed up the warm-up process, heat moves to the belt and ends up being radiated while the heating roller is in the course of reaching its set temperature, and this makes it take longer for the heating roller to reach its set temperature.

In view of this, with the prior art disclosed in Japanese Laid-Open Patent Application H6-148856, this movement of heat is curbed by loosening the temperature of the belt on the heating roller. When the tension is loosened, though, a few seconds are lost when the tension is reapplied, so despite the effort to minimize the excess radiation of heat, time is spent reapplying tension, so at present there is little merit to accelerating the warm-up process.

Technologies relating to the present invention are (also) disclosed in, e.g., Japanese Laid-Open Patent Applications 2001-20966 and 2002-251089.

SUMMARY OF THE INVENTION

In light of the above problems, it is an object of the present invention to provide a fixing apparatus with which the movement of heat to the fixing belt during warm-up is suppressed, and the time it takes for the heating roller temperature to rise can be shortened, by reducing the contact surface area between the fixing belt and the heating roller, and an image formation apparatus that makes use of this fixing apparatus, and a toner used therein.

In accordance with the present invention, there is provided a fixing apparatus for fixing toner on a passing recording medium, comprising a fixing belt stretched around a plurality of rollers including a heating roller and a fixing roller, a press roller disposed across from the fixing belt, and a tension roller for applying tension to the fixing belt, wherein the fixing apparatus further comprises adjustment device for adjusting the contact surface area of the fixing belt on the heating roller.

Also provided is an image formation apparatus, comprising an image support on which a latent image is formed, a charging apparatus for uniformly charging the image support surface, an exposure apparatus which renders exposure on the image support surface, which is charged, and writes in the latent image on the basis of the image data, a developing apparatus for producing a visible image by supplying toner to the latent image formed on the image support surface, a cleaning apparatus for cleaning the image support surface, a transfer apparatus for transferring the visible image on the image support surface to a recording medium, either directly or after first transferring to an intermediate transfer medium, and a fixing apparatus for fixing the toner image on the recording medium, wherein the fixing apparatus for fixing toner on a passing recording medium is used, the fixing apparatus comprising a fixing belt stretched around a plurality of rollers including a heating roller and a fixing roller, a press roller disposed across from the fixing belt, a tension roller for applying tension to the fixing belt, and adjustment device for adjusting the contact surface area of the fixing belt on the heating roller.

Also provided is a toner used in an image formation apparatus, whose weight average particle size is 10 μm or less, and whose ratio of weight average particle size to number average particle size (degree of dispersion) is within the range of 1.00 to 1.40, the image formation apparatus comprising an image support on which a latent image is formed, a charging apparatus for uniformly charging the image support surface, an exposure apparatus which renders exposure on the image support surface, which is charged, and writes in the latent image on the basis of the image data, a developing apparatus for producing a visible image by supplying toner to the latent image formed on the image support surface, a cleaning apparatus for cleaning the image support surface, a transfer apparatus for transferring the visible image on the image support surface to a recording medium, either directly or after first transferring to an intermediate transfer medium, and a fixing apparatus for fixing the toner image on the recording medium, wherein a fixing apparatus for fixing toner on a passing recording medium is used, the fixing apparatus comprising a fixing belt stretched around a plurality of rollers including a heating roller and a fixing roller, a press roller disposed across from the fixing belt, a tension roller for applying tension to the fixing belt, and adjustment device for adjusting the contact surface area of the fixing belt on the heating roller.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

An embodiment of the present invention will now be described in detail through reference to the drawings.

Figure 1A:
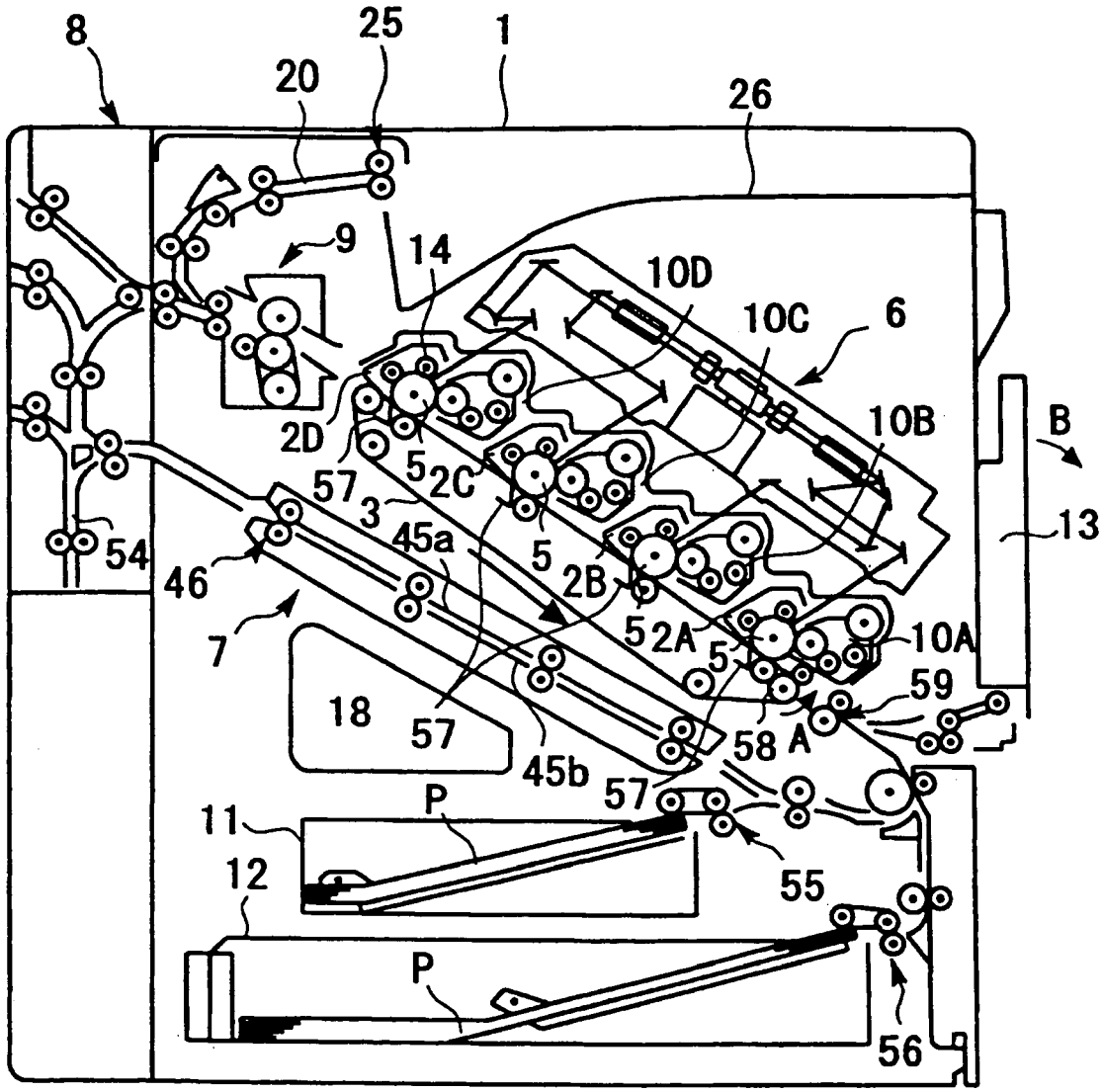
FIGS. 1A and 1B are diagrams of the simplified structure of the image formation apparatus pertaining to an embodiment of the present invention.
Figure 1B:
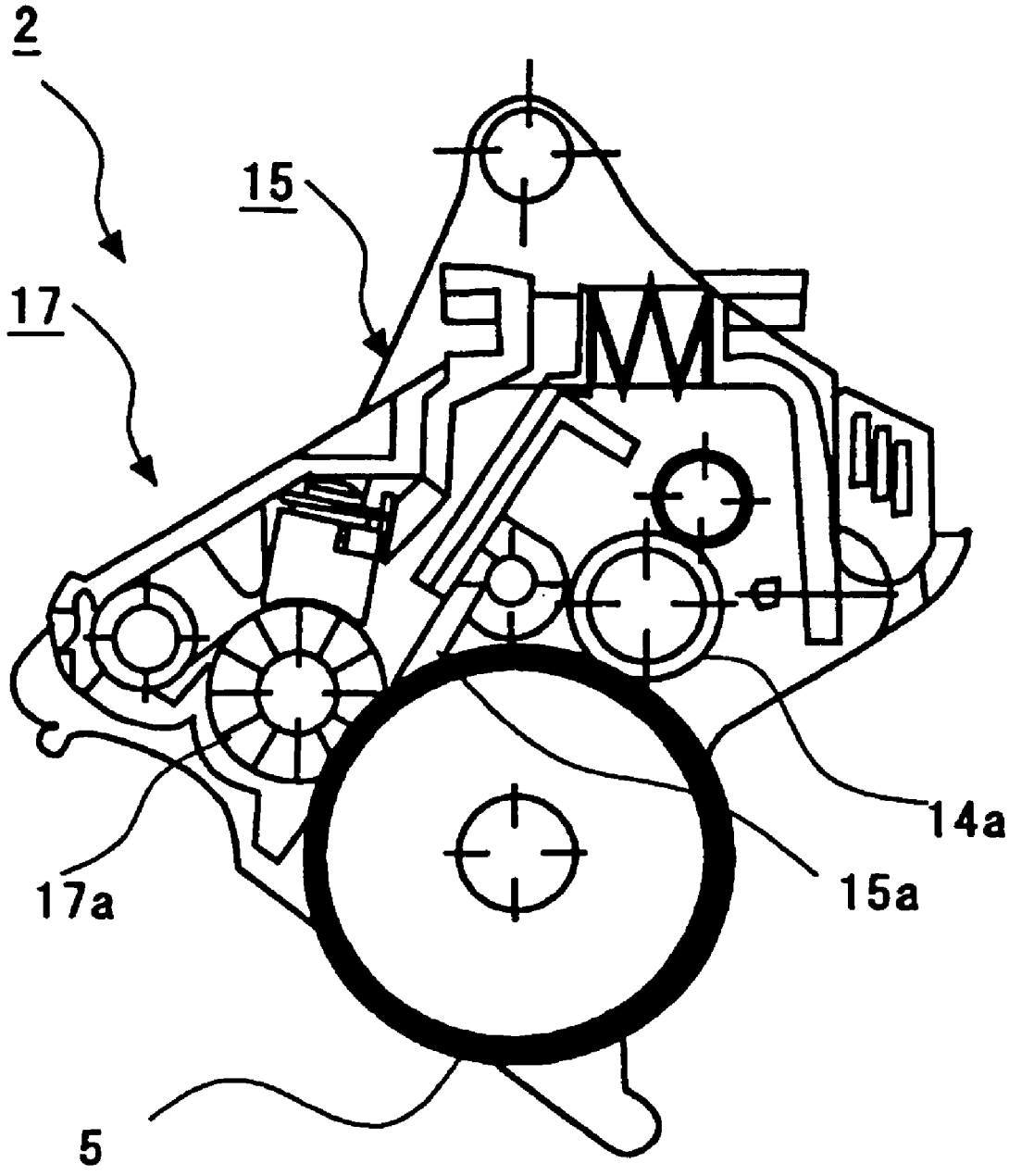

FIGS. 1A and 1B are diagrams of the simplified structure of the image formation apparatus pertaining to an embodiment of the present invention. FIG. 1A is an overall view of the image formation apparatus, and FIG. 1B is a simplified diagram of the structure of the image formation unit.

Four image formation units 2A, 2B, 2C, and 2D, each having a photosensitive member (image support), are detachably installed inside an image formation apparatus 1. A transfer apparatus 3, in which a transfer belt 3*a* is mounted rotatably in the direction of arrow A between a plurality of rollers, is disposed in the approximate center of the image formation apparatus 1. The photosensitive members 5 provided to the image formation units 2A, 2B, 2C, and 2D are disposed so as to be in contact with the top side of this transfer belt 3*a*. Developing apparatus 10A, 10B, 10C, and 10D, each of which use a toner of a different color, are disposed corresponding to these image formation units 2A, 2B, 2C, and 2D.

The image formation units 2A, 2B, 2C, and 2D all have the same structure, but the image formation unit 2A forms an image corresponding to magenta, the image formation unit 2B forms an image corresponding to cyan, the image formation unit 2C forms an image corresponding to yellow, and the image formation unit 2D forms an image corresponding to black.

A write unit 6 is disposed above the image formation units 2A, 2B, 2C, and 2D, and a double-sided unit 7 is disposed below the transfer belt 3*a*. With this small printer, an inversion unit 8 that inverts and discharges the recording medium P on which an image has been formed, or that conveys the recording medium P to the double-sided unit 7, is mounted to the left of the image formation apparatus 1.

The write unit 6 comprises four laser diode (LD) type light sources that are for use with the various colors, a set of polygonal scanners consisting of a six-sided polygonal mirror and a polygonal motor, and an fθ lens, long cylindrical lens, or other such lens or mirror disposed in the optical path of each light source. The laser beam emitted from the laser diode is deflected and scanned by the polygonal scanner and directed onto a photosensitive member 5.

The double-sided unit 7 consists of a pair of conveyor guide plates 45*a* and 45*b*, and a plurality of pairs (four pairs in this example) of conveyor rollers 46. In double-sided image formation mode, in which images are formed on both sides of the recording medium P, an image is formed on one side, the recording medium is conveyed to an inversion conveyance path 54 of the inversion unit 8, and the recording medium P is received at a switchback and conveyed toward the paper feeder. The inversion unit 8 consists of a plurality of pairs of the conveyor rollers 46 and a plurality of pairs of conveyance guide plates 45, and as mentioned above, during the formation of images on both sides, inverts the recording medium P front to back and conveys it to the double-sided unit 7, or discharges the recording medium P on which an image has been formed without it being inverted to outside the machine, or inverts it front to back and discharges it to outside the machine.

Paper cassettes 11 and 12 of the paper feeder are respectively provided with separating paper feeders 55 and 56 for separating and feeding the recording medium P one sheet at a time. A fixing apparatus 9 for fixing the image of the recording medium P onto which an image has been transferred is provided between the transfer belt 3*a* and the inversion unit 8. An inversion paper discharge path 20 branches off downstream in the recording medium conveyance direction of the fixing apparatus 9, and any recording medium P conveyed to this path can be discharged into a paper discharge tray 26 by a pair of paper discharge rollers 25.

The paper cassettes 11 and 12, which are capable of holding recording media P of different sizes in upper and lower levels is disposed at the bottom part of the image formation apparatus 1. Further, a manual by-pass tray 13 is provided openable in the direction of arrow B on the right side of the image formation apparatus 1, and paper can be manually fed by opening this manual by-pass tray 13.

Figure 2:
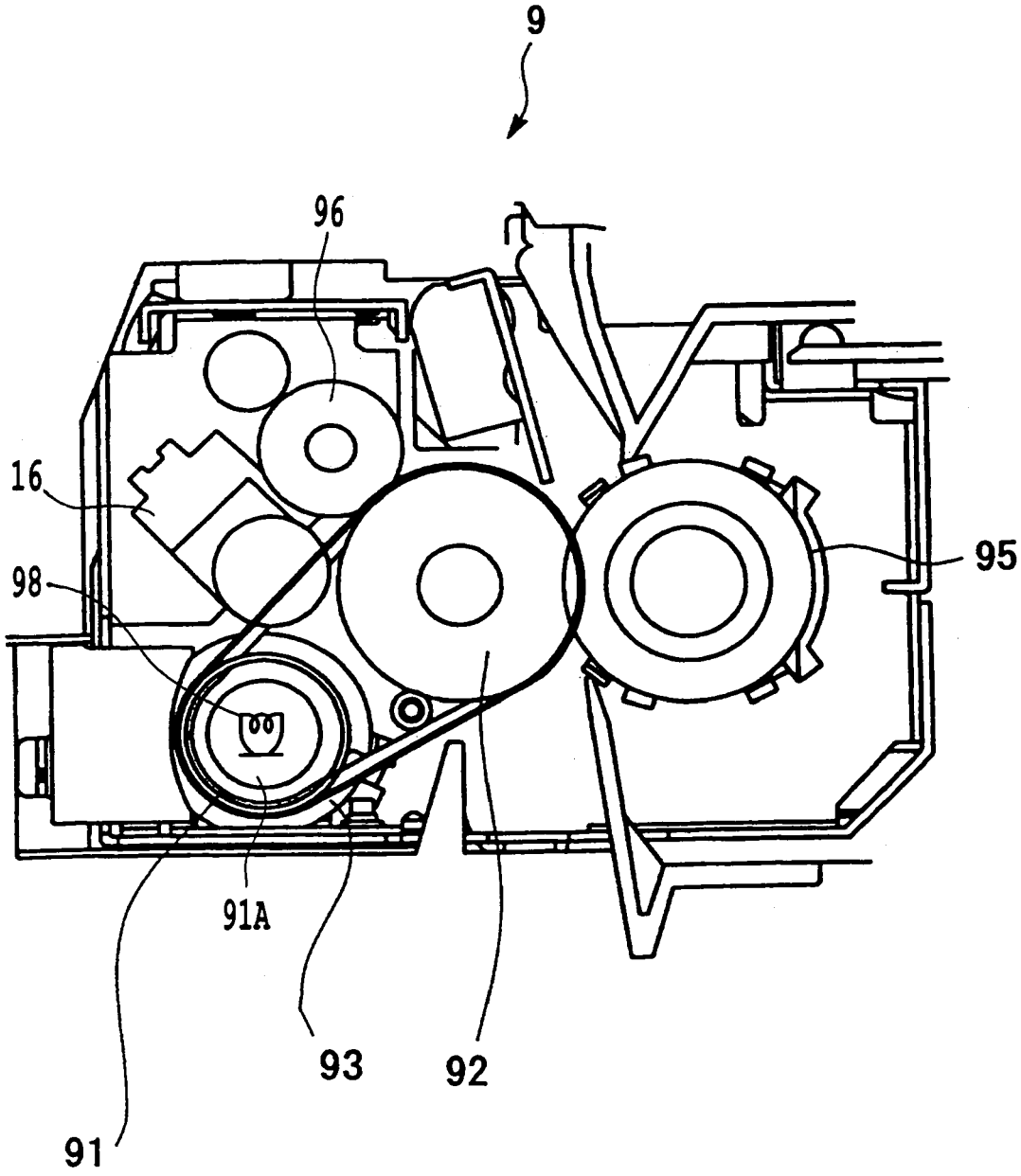
FIG. 2 is a diagram of the simplified structure of the fixing apparatus pertaining to this embodiment.

FIG. 2 is a diagram of the simplified structure of the fixing apparatus pertaining to this embodiment.

As shown in FIG. 2, the fixing apparatus 9 of this embodiment comprises a heating roller 91, a fixing roller 92, a press roller 95 that presses on the fixing roller 92, a fixing belt 93 that spans the heating roller 91 and the fixing roller 92, and an adjustment means 16 equipped with a tension roller that applies tension to the fixing belt 93. Further, a heating member 98 is provided to at least one of the heating roller 91, fixing roller 92, and press roller 95 around which the fixing belt 93 is stretched.

A coating roller 96 for applying silicone oil or another such oil that improves parting is provided to the fixing belt 93 in order to improve toner parting and prevent the occurrence of offset. Furthermore, a temperature sensor 91A for sensing the temperature of the heating roller 91 is provided in order to control the heating of these components.

The substrate of the fixing belt 93 is an endless belt-form substrate formed from a metal or a heat-resistant resin. Examples of the material of the heat-resistant resin include polyimide, polyamide-imide, and polyether ether ketone, and examples of the material of a metal belt include nickel, aluminum, and stainless steel. A resin laminate may be formed, and a belt produced by electrocasting nickel on a polyimide resin is particularly favorable because it is strong and elastic and has good durability. The belt is preferably thin, with a thickness of no more than 100 μm.

Because it comes into pressurized contact with the toner and the recording medium or other such recording medium, the fixing belt has an elastic layer composed of silicone rubber or another material with good parting properties, and a heat-resistant parting layer made of a fluororesin with a low coefficient of friction. The fluororesin is applied to the substrate surface by spraying or the like, and then heated and fused to form a surface parting layer. The silicone rubber layer with good parting properties preferably has a rubber hardness (JIS A hardness tester) of 25 to 65 degrees, a thickness between 100 and 300 μm, and good fixability and thermal responsiveness. This gives the fixing belt excellent partability, heat resistance, and durability.

The heating roller 91 carries the fixing belt 93 that is wound around it, and is used for heating. Accordingly, a halogen lamp, nichrome wire, or other such heating member 98 is provided in the interior of the heating roller 91. Also, the heating roller 91 is a thin-walled roller in the form of a hollow metal cylinder made of aluminum, carbon steel, stainless steel, or the like, and the temperature distribution in the axial direction can be reduced by using an aluminum cylinder with a thickness of 1 to 4 mm, which will afford better thermal conduction. The surface of the heating roller 91 is subjected to an alumite treatment in order to prevent wear between this surface and the fixing belt 93.

Also, the fixing roller 92 forms a nip with the press roller 95, which faces the fixing roller 92 with the fixing belt 93 sandwiched therebetween, and as the recording paper is squeezed and conveyed through this nip, the toner on the recording paper is heated and pressed. Accordingly, the fixing roller 92 comprises a silicone rubber or other such elastic layer provided in a thickness of 100 to 500 μm, and preferably 400 μm, to the surface of a metal core, and a resin surface layer with good partability, such as a fluororesin, is formed for the purpose of preventing the adhesion that would otherwise be caused by the tackiness of the toner. A resin surface layer is formed. The fluororesin of this resin surface layer consists of a PFA tube or the like, and when mechanical degradation is taken into account, the thickness of this layer is preferably about 10 to 50 μm. The core of the fixing roller 92 consists of a metal cylinder of stainless steel or the like, and the heating member 98 (such as a halogen lamp) is provided along the axial center of the roller.

The press roller 95 comprises a metal cylinder of stainless steel or the like, which is covered with an elastic layer of silicone rubber with a thickness of 2 mm, and this surface is covered with a parting layer for preventing offset and made of a tetrafluoroethylene-perfluoroalkyl vinyl ether (PFA), polytetrafluoroethylene (PTFE), or other such fluororesin. The heating member 98 is disposed on the inside of the cylinder, with the structure being the same as that inside the fixing roller 92. The press roller 95 is pressed on by a pressing member such as a spring (not shown) toward the fixing roller 92 and with the fixing belt 93 sandwiched therebetween, and the rubber layer is elastically deformed, which forms a nip with the fixing roller 92, which allows the toner to be pressed and heated for a specific length of time.

FIGS. 3 to 8 are diagrams of examples of the layout of the adjustment means for adjusting the contact surface area of the fixing belt on the heating roller in this embodiment.

Figure 3:
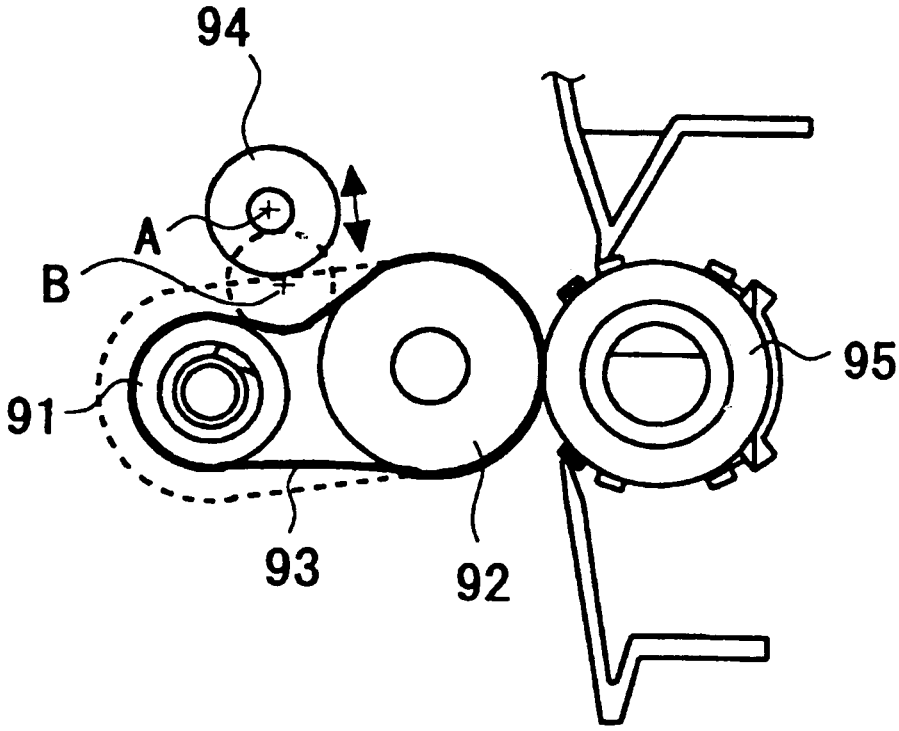
FIG. 3 is a diagram of how the adjustment means adjusts the contact surface area between the heating roller and the fixing belt.

FIG. 3 is a diagram of how the adjustment means adjusts the contact surface area between the heating roller 91 and the fixing belt 93. During warm-up, the adjustment means is disposed at A, so that the fixing belt 93 is disposed as indicated by the broken line and reduces the contact surface area, and this suppresses the radiation of heat from the heating roller 91 to the fixing belt. After the heating roller 91 has reached its set temperature, the adjustment means is moved to B, so that the fixing belt 93 is disposed as indicated by the solid line, which increases the contact surface area, so that the temperature of the fixing belt 93 rises instantaneously. The adjustment means in this case may be a tension roller 94, or a coating roller (oil coating member).

Figure 4:
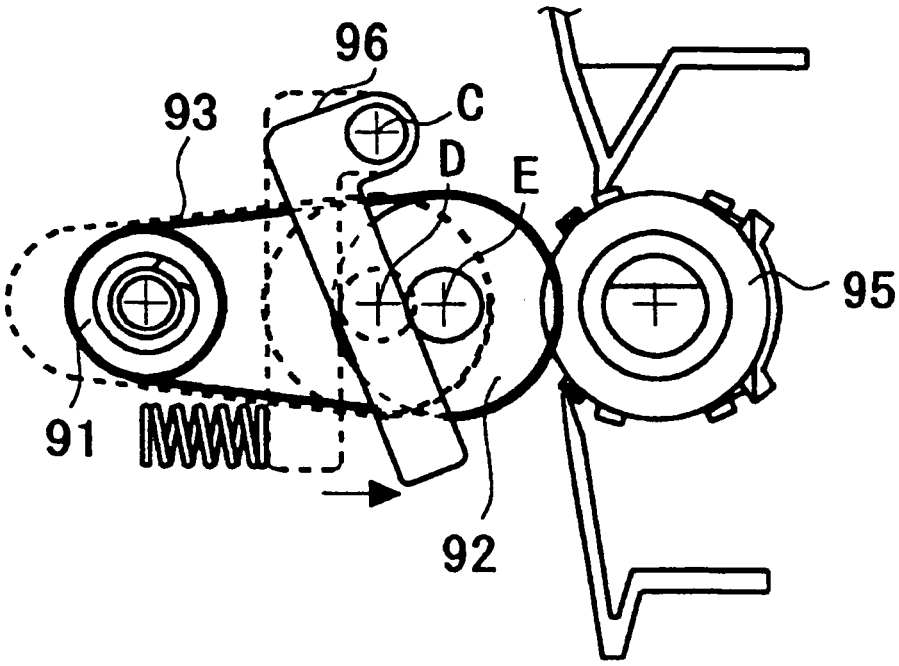
FIG. 4 is a diagram of how the position of the fixing roller is moved by rotating this adjustment means.

FIG. 4 is a diagram of how the position of the fixing roller 92 is moved by rotating the adjustment means 96 in the direction of the arrow around a fulcrum C. During warm-up, the center of the fixing roller 92 is located at D, so that the fixing belt 93 is disposed as indicated by the broken line, but during fixing, the center of the fixing roller 92 is located at E, so that the fixing belt 93 is disposed as indicated by the solid line. The adjustment means 96 moves the fixing roller 92 such that the fixing belt 93 moves away from the heating roller 91, which reduces the contact surface area between the fixing belt 93 and the heating roller 91 during warm-up.

Figure 5:
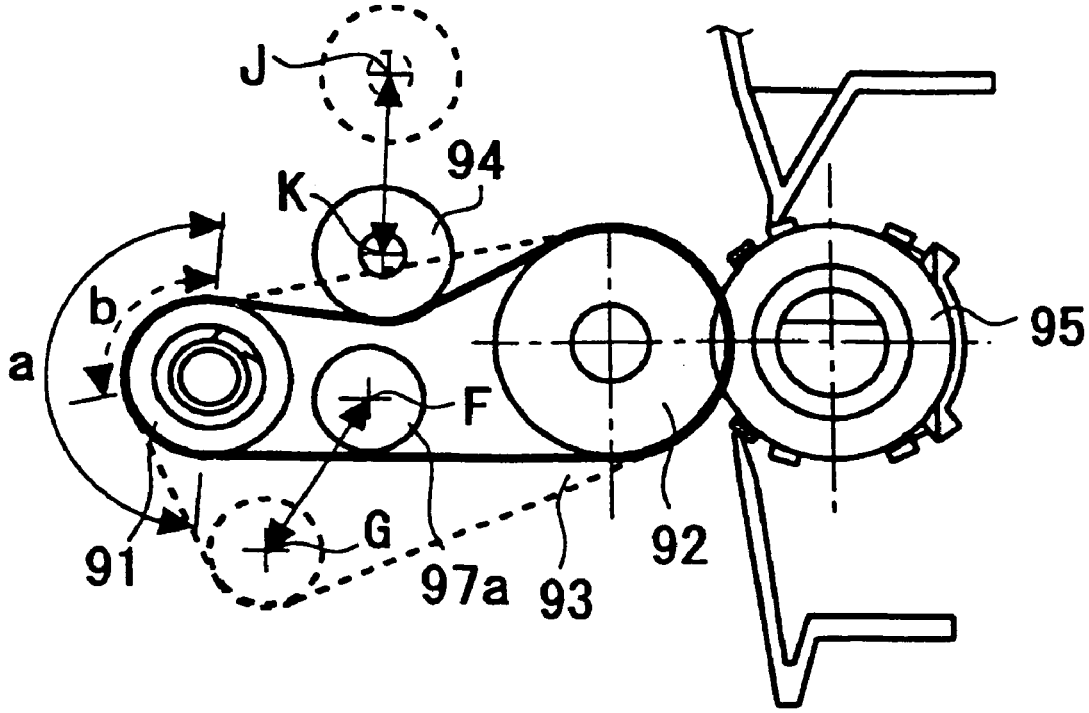
FIG. 5 is a diagram of how the separation member is provided on the inside of the fixing belt.

FIG. 5 is a diagram of how a separation member 97*a* is provided as the adjustment means on the inside of the fixing belt 93. The separation member 97*a* rotates alone with the fixing belt 93. During warm-up, the center of the separation member 97*a* is located at G, and the center of a tension roller 94 is located at J. During fixing, the center of the separation member 97*a* is located at F, and the center of the tension roller 94 is located at K. If we express the distance over which the fixing belt 93 is in contact with the heating roller 91 as the distance traveled by the fixing belt, then a is the distance during fixing, and b is the distance during warm-up. As shown in FIG. 5, a>b, so there is less radiation of heat from the heating roller 91 to the 93 during warm-up than during fixing. In FIG. 5, the contact surface area of the fixing belt 93 on the heating roller 91 during warm-up is adjusted by moving the positions of the separation member 97*a* and the tension roller 94.

Figure 6:
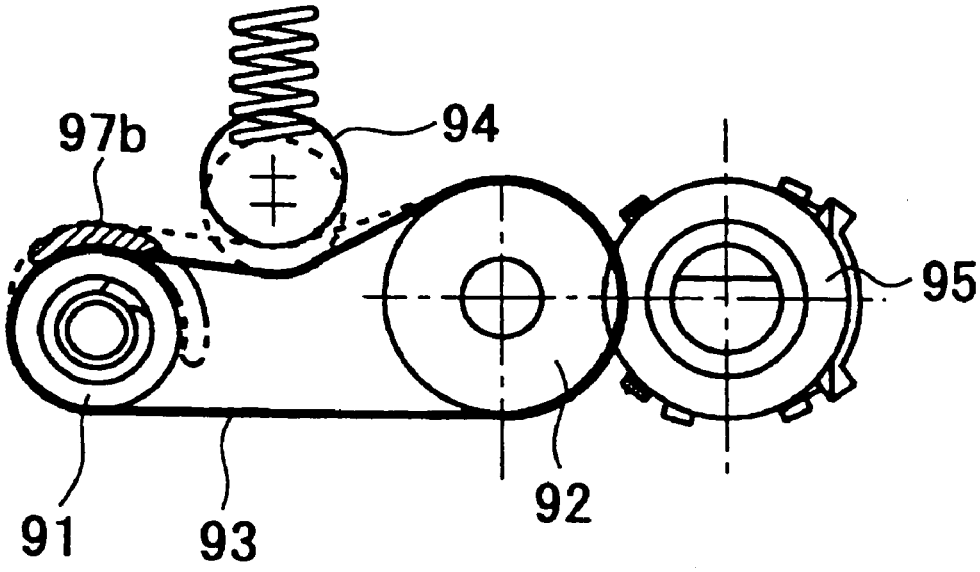
FIG. 6 is a diagram of the separation member inserted between the fixing belt and the heating roller.

FIG. 6 is a diagram of a separation member 97*b* inserted between the fixing belt 93 and the heating roller 91. Since the separation member is made of a heat-resistant resin or rubber, inserting it between the fixing belt 93 and the heating roller 91 adjusts the contact surface area during warm-up and reduces the amount of heat radiated from the heating roller 91 to the fixing belt 93.

Figure 7:
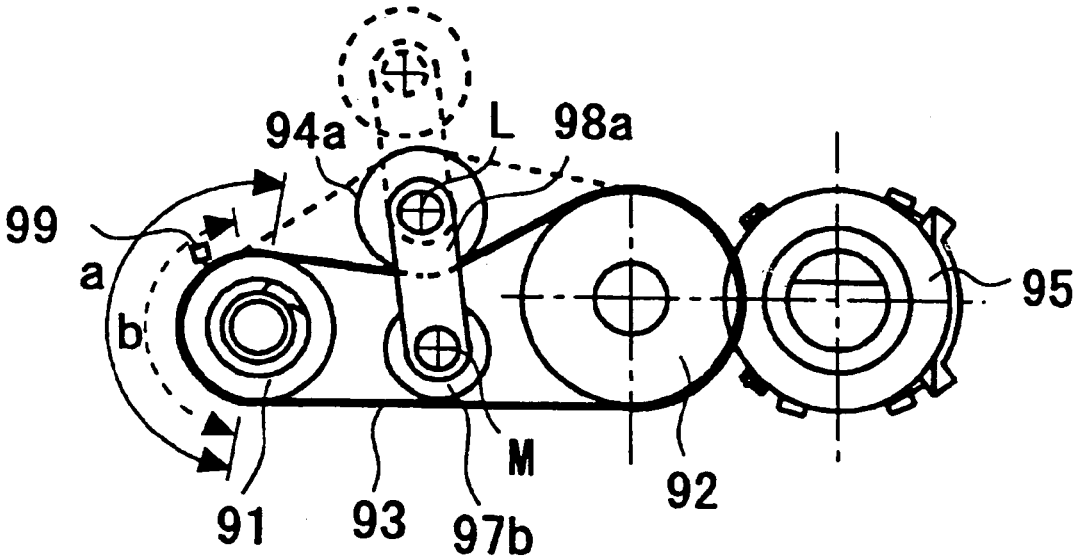
FIG. 7 is a diagram of how the separation member forms a pair with the tension roller, and these move in a straight line.

FIG. 7 is a diagram of how the separation member 97*b* forms a pair with a tension roller 94*a*. Because the separation member 97*b* and the tension roller 94*a* are integrated, it is possible to adjust the contact surface area between the fixing belt 93 and the heating roller 91 by moving the separation member 97*b* and the tension roller 94*a* simultaneously in a straight line. In FIG. 7, during warm-up, the center of the separation member 97*b* is located at L, and this separation member presses against and moves with the fixing belt 93 so that this belt is pushed outward, and during fixing, is located at M and is away from the fixing belt 93. Conversely, the tension roller 94*a* is not in contact with the fixing belt 93 during warm-up, and during fixing pushes the fixing belt 93 inward. During warm-up, the fixing belt 93 is in contact with the heating roller 91 at position b, and during fixing, the fixing belt 93 is in contact with the heating roller 91 at position a. Since a>b, as is clear from FIG. 7, less heat is radiated from the heating roller 91 to the fixing belt 93 during warm-up.

Also, integrating the separation member 97*b* and the tension roller 94*a* allows a switching means 98*a* to be used for position movement, which means that a position can be switched instantaneously.

Figure 8:
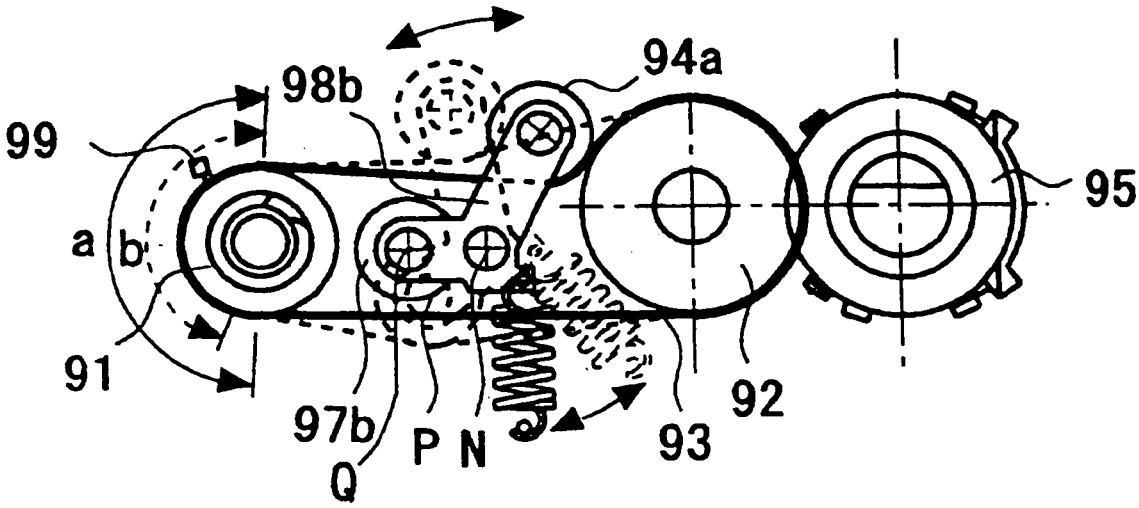
FIG. 8 is a diagram of how the separation member forms a pair with the tension roller, and these move rotationally.

FIG. 8 is a diagram of how the separation member 97*b* forms a pair with the tension roller 94*a*, just as in FIG. 7. Whereas the separation member 97*b* and the tension roller 94*a* are moved simultaneously in a straight line in FIG. 7, though, in FIG. 8 the separation member 97*b* and the tension roller 94*a* are rotated simultaneously around a center N. During warm-up, the center of the separation member 97*b* is located at P, and this separation member presses against and moves with the fixing belt 93 so that this belt is pushed outward, and during fixing, is located at Q and is away from the fixing belt 93. Conversely, the tension roller 94*a* is not in contact with the fixing belt 93 during warm-up, and during fixing pushes the fixing belt 93 inward. During warm-up, the fixing belt 93 is in contact with the heating roller 91 at position b, and during fixing, the fixing belt 93 is in contact with the heating roller 91 at position a. Since a>b, as is clear from FIG. 8, less heat is radiated from the heating roller 91 to the fixing belt 93 during warm-up.

Also, with the configuration in FIG. 8, just as with the configuration in FIG. 7, integrating the separation member 97*b* and the tension roller 94*a* allows a switching means 98*a* to be used for position movement, which means that a position can be switched instantaneously.

Furthermore, with the configurations in FIGS. 7 and 8, if a temperature sensor 99 is provided to the heating roller 91, then switching can be performed with switching means 98*a* and 98*b* when a set temperature is detected.

Thus, using a fixing apparatus as described for any of FIGS. 3 to 8 in an image formation apparatus makes it possible to shorten the standby time during warm-up by minimizing the movement of heat from the heating roller 91 to the fixing belt 93 during warm-up.

The toner used in this image formation apparatus is specified to have a weight average particle size of 10 μm or less. Fine images will be difficult to reproduce if the weight average particle size is over 10 μm. Even finer images can be reproduced if the size is no more than 8 μm. However, the weight average particle size is specified to be at least 3 μm. Cleaning with a cleaning blade system will be difficult if the size is less than 3 μm. Also, the surface area per unit weight of the toner will be greater, and conversely the thermal capacity per particle will be smaller, so the toner will melt more readily and photo-offsetting will be apt to occur. The degree of dispersion, expressed by the ratio between the weight average particle size and the number average particle size, is specified to be within a range of 1.00 to 1.40. If the degree of dispersion is over 1.40, contact between the toner particles and the fixing belt 93 will not be uniform, photo-offsetting may occur, part of the toner will be offset to the fixing belt 93 and a cleaning roller 97, and the toner will be more likely to "melt out."

Also, the average circularity of the toner particles is at least 0.93. With a toner manufactured by dry pulverization, this circularity is achieved by thermal or mechanical sphericalization. An example of a thermal sphericalization treatment is to spray the toner particles along with a hot gas flow using an atomizer or the like. Mechanical sphericalization can be accomplished by stirring the toner along with a mixing medium such as glass with a low specific gravity in a mixer such as a ball mill. However, with thermal sphericalization, the toner particles agglomerate into secondary particles of large size, while mechanical sphericalization can produce a micropowder, so the particles will have to go through another grading process. Also, with a toner manufactured in an aqueous solvent, the shape can be controlled by stirring vigorously in the process of removing the solvent.

Circularity is defined as follows: Circularity SR={(circumference of a circle with the same area as the projected particle area)/(circumference of particle projection)}×100. The closer the toner particles are to being spherical, the closer is the value to 100%. A toner with high circularity is readily affected by electrical power lines on a developing sleeve 5*a* or carrier, and is faithfully developed along the electrical power lines of the electrostatic latent image. When microscopic latent image dots are being reproduced, it is easier to achieve a dense and uniform toner disposition, so fine line reproducibility is better.

Also, a toner of high circularity uniformly accepts heat from the fixing belt 93 and so forth, so photo-offsetting is less likely to occur, and toner melt-out can be reduced. If the circularity is less than 0.93, there will be little effect of minimizing melt-out. This is because if the shape is heterogeneous, the state of contact between the press roller 95 and the fixing belt 93 will vary with the toner particles, a tiny amount of photo-offsetting will occur and this toner will foul the fixing belt 93 and the cleaning roller 97, and toner melt-out will occur.

Also, of this circularity it is preferable for the toner to have a shape factor SF-1 within a range of 100 to 180, and a shape factor SF-2 within a range of 100 and 180. Shape factor SF-1 indicates the proportional roundness of the toner shape, and is expressed by the following equation (1). This value is obtained by dividing the square of the maximum length MXLNG of the shape produced by projecting a toner particle in a two-dimensional plane, by the figural surface area AREA, and then multiplying by 100π/4.

$$SF\text{-}1=(MXLNG^2/\mathrm{AREA})\times(100\pi/4) \qquad \text{Eq. 1}$$

If the value of SF-1 is 100, the shape of the toner is spherical, and the greater is the value of SF-1, the more irregular the shape.

Shape factor SF-2 indicates the proportional bumpiness of the toner shape, and is expressed by the following equation (2). This value is obtained by dividing the square of the perimeter PERI of the figure produced by projecting a toner particle in a two-dimensional plane, by the figural surface area AREA, and then multiplying by 100π/4.

$$SF\text{-}2=(\mathrm{PERI}^2/\mathrm{AREA})\times(100\pi/4) \qquad \text{Eq. 2}$$

If the value of SF-2 is 100, no bumps are present on the toner surface, and the greater is the value of SF-2, the more pronounced is the bumpiness of the toner surface.

In specific terms, the shape factor is measured by photographing toner particles with a scanning electron microscope (S-800 made by Hitachi), putting this photograph in an image analyzer (Lusex 3 made by Nireko), and making calculations from this analysis.

The shape factors SF-1 and SF-2 of the toner should be at least 100. Also, there greater are SF-1 and SF-2, the more inconsistent is the shape, and with a non-uniform shape, the state of contact between the press roller 95 and the fixing belt 93 will vary with the toner particles, a tiny amount of photo-offsetting will occur and this toner will foul the fixing belt 93 and the cleaning roller 97, and toner melt-out will occur. It is therefore preferable for neither SF-1 nor SF-2 to be over 180.

This toner has a substantially spherical shape, whose ratio of major axis to minor axis (r1/r2) is within the range of 0.5 to 1.0, and whose ratio of thickness to minor axis (r3/r2) is within the range of 0.7 to 1.0. The axis ratio is measured with a scanning electron microscope (SEM), with the field angle varied while observations are made. If the ratio of major axis to minor axis (r1/r2) is less than 0.5 and the ratio of thickness to minor axis (r3/r2) is less than 0.7, the toner will have an uneven shape, the charge distribution will be wider, there will be more fogging and toner specks around characters, and image quality will suffer. Also, the state of contact with the fixing belt 93 will be uneven, a tiny amount of photo-offsetting will occur and this toner will foul the fixing belt 93 and the cleaning roller 97, and toner melt-out will occur.

It is also preferable for this substantially spherical toner to be obtained by subjecting a toner composition containing at least a polyester prepolymer including a nitrogen atom and having a functional group, a polyester, a colorant, and a parting agent to crosslinking and/or an extension reaction in an aqueous medium and in the presence of resin microparticles. A toner manufactured by this reaction can be made to undergo less photo-offsetting by curing the toner surface, and as a result there will be less fouling of the fixing belt 93 and the cleaning roller 97, and less melt-out of the toner.

The materials that make up the toner and a favorable method for manufacturing this toner will now be described.

Polyester

Polyester is obtained by the polycondensation of a polyhydric alcohol compound and a polycarboxylic acid compound.

Examples of polyhydric alcohol compounds (PO) include dihydric alcohol (DIO) and trihydric and higher polyhydric alcohols (TO). DIO alone or a mixture of DIO and a small amount of TO is preferred. Examples of dihydric alcohols (DIO) include alkylene glycols (such as ethylene glycol, 1,2-propylene glycol, 1,3-propylene glycol, 1,4-butanediol, and 1,6-hexanediol), alkylene ether glycols (such as diethylene glycol, triethylene glycol, dipropylene glycol, polyethylene glycol, polypropylene glycol, and polytetramethylene ether glycol), alicyclic diols (such as 1,4-cyclohexanedimethanol and hydrogenated bisphenol), bisphenols (such as bisphenol A, bisphenol F, and bisphenol S), alkylene oxide (such as ethylene oxide, propylene oxide, and butylene oxide) adducts of the above-mentioned alicyclic diols, and alkylene oxide (such as ethylene oxide, propylene oxide, and butylene oxide) adducts of the above-mentioned bisphenols. Of these, $C_2$ to $C_{12}$ alkylene glycols and alkylene oxide adducts of bisphenols are preferred, and it is particularly favorable to use an alkylene oxide adduct of a bisphenol, or a combination of one of these and a $C_2$ to $C_{12}$ alkylene glycol. Examples of trihydric and higher polyhydric alcohols (TO) include trihydric to octahydric or higher polyhydric aliphatic alcohols (such as glycerol, trimethylolethane, trimethylolpropane, pentaerithrytol, and sorbitol), trihydric and higher phenols (such as trisphenol PA, phenol novolac, and cresol novolac), and alkylene oxide adducts of the above-mentioned trihydric and higher polyphenols.

Examples of polycarboxylic acids (PC) include dicarboxylic acid (DIC) and trivalent and higher polycarboxylic acids (TC). DIC alone or a mixture of DIC and a small amount of TC is preferred. Examples of dicarboxylic acids include alkylenedicarboxylic acids (such as succinic acid, adipic acid, and sebacic acid), alkenyldicarboxylic acids (such as maleic acid and fumaric acid), and aromatic dicarboxylic acids (such as phthalic acid, isophthalic acid, terephthalic acid, and naphthalenedicarboxylic acid). Of these, $C_4$ to $C_{20}$ alkenyldicarboxylic acids and $C_8$ to $C_{20}$ aromatic dicarboxylic acids are preferred. Examples of trivalent and higher polycarboxylic acids (TC) include $C_9$ to $C_{20}$ aromatic polycarboxylic acids (such as trimellitic acid and pyromellitic acid). The polycarboxylic acid (PC) may also be an anhydride of one of the above acids, or may be reacted with a polyhydric alcohol (PO) using a lower alkyl ester (such as a methyl ester, ethyl ester, or isopropyl ester).

The proportion of polyhydric alcohol (PO) to polycarboxylic acid (PC), as the equivalent ratio OH/COOH of hydroxyl groups (OH) to carboxyl groups (COOH), is usually from 2/1 to 1/1, and preferably from 1.5 to 1/1, with a range of 1.3/1 to 1.02/1 being even better.

The polycondensation reaction of the polyhydric alcohol (PO) and polycarboxylic acid (PC) is carried out by heating to between 150 and 280° C. in the presence of a known esterification catalyst (such as tetrabutoxy titanate or dibutyltin oxide), and distilling off any water that is produced while reducing the pressure as needed, to obtain a polyester having hydroxyl groups. The hydroxyl value of the polyester is preferably at least 5, and the acid value of the polyester is usually from 1 to 30, and preferably 5 to 20. An acid value facilitates imparting a negative charge, and also improves low-temperature fixability due to better affinity between the toner and the recording paper during fixing to recording paper. However, if the acid value is over 30, charge stability, and particularly that with respect to environmental fluctuations, will tend to decrease.

Also, the weight average molecular weight is from 10,000 to 400,000, and preferably from 20,000 to 200,000. It is undesirable for the weight average molecular weight to be less than 10,000 because photo-offsetting will occur. Also, fixability cannot be ensured if 400,000 is exceeded.

In addition to an unmodified polyester obtained from the above-mentioned polycondensation reaction, it is preferable for a urea-modified polyester to be contained. A urea-modified polyester is obtained by reacting a polyisocyanate compound (PIC) with the terminal carboxyl groups, hydroxyl groups, etc., or the polyester obtained from the above-mentioned polycondensation reaction, to obtain a polyester prepolymer (A) having isocyanate groups, and reacting this with an amine to crosslink and/or extend the molecular chain.

Examples of polyisocyanate compounds (PIC) include aliphatic polyisocyanates (such as tetramethylene diisocyanate, hexamethylene diisocyanate, and 2,6-diisocyanatomethyl caproate), alicyclic polyisocyanates (such as isophorone diisocyanate and cyclohexylmethane diisocyanate), aromatic diisocyanates (such as tolylene diisocyanate and diphenylmethane diisocyanate), isocyanates, the above-mentioned polyisocyanates that have been blocked with a caprolactam, oxime, phenol derivative, or the like, and combinations of two or more of these.

The proportion of polyisocyanate compound (PIC), as the equivalent ratio NCO/OH of isocyanate groups (NCO) to hydroxyl groups (OH) in the polyester having hydroxyl groups, is usually from 5/1 to 1/1, and preferably from 4/1 to 1.2/1, with a range of 2.5/1 to 1.5/1 being even better. Low-temperature fixability will suffer if NCO/OH is over 5. If the molar ratio of NCO is less than 1, when a urea-modified polyester is used, the urea content will be low in this ester, and resistance to photo-offsetting will decrease.

The amount in which the polyisocyanate compound (PIC) constituent component is contained in the isocyanate-group-containing polyester prepolymer (A) is usually 0.5 to 40 wt %, and preferably 1 to 30 wt %, with a range of 2 to 20 wt % being even better. Below 0.5 wt %, resistance to photo-offsetting will decrease, and this is also disadvantageous in terms of how long heat resistance lasts and low-temperature fixability.

There is usually at least one isocyanate group contained in each molecule of the isocyanate-group-containing polyester prepolymer (A), and on average 1.5 to 3 such groups, and preferably the average is from 1.8 to 2.5 groups. If there is fewer than one group per molecule, the molecular weight of the urea-modified polyester will be low, and photo-offsetting resistance will be worse.

Examples of the amine (B) that is reacted with the polyester prepolymer (A) include diamine compounds (B1), triamine and higher polyamine compounds (B2), aminoalcohols (B3), aminomercaptans (B4), amino acids (B5), and the products of blocking the amino groups of B1 to B5 (B6).

Examples of diamine compounds (B1) include aromatic diamines (such as phenylenediamine, diethyltoluenediamine, and 4,4'-diaminodiphenylmethane), alicyclic diamines (4,4'-diamino-3,3'-dimethyldicyclohexylmethane, diaminocyclohexane, and isophoronediamine), and aliphatic diamines (such as ethylenediamine, tetramethylenediamine, and hexamethylenediamine). Examples of triamine and higher polyamine compounds (B2) include diethylenetriamine and triethylenetetraamine. Examples of aminoalcohols (B3) include ethanolamine and hydroxyethylaniline. Examples of aminomercaptans (B4) include aminoethylmercaptan and aminopropylmercaptan. Examples of amino acids (B5) include aminopropionic acid and aminocaproic acid. Examples of compounds in which the amino groups of B1to B5have been blocked (B6) include oxazolidine compounds and ketimine compounds obtained from ketones (such as acetone, methyl ethyl ketone, and methyl isobutyl ketone) and the above-mentioned amines of B1 to B5. Of these amine compounds (B), B1 and a mixture of B1 and a small amount of B2 are preferred.

The proportion of amine compound (B), as the equivalent ratio NCO/NHx of the isocyanate groups (NCO) in the isocyanate-group-containing polyester prepolymer (A) to amino groups (NHx) in the amine (B), is usually from 1/2 to 2/1, and preferably from 1.5/1 to 1/1.5, with a range of 1.2/1 to 1/1.2 being even better. If NCO/NHx is over 2 or less than 1/2, the molecular weight of the urea-modified polyester will be low and resistance to photo-offsetting will decrease.

The urea-modified polyester may also contain urethane bonds along with urea bonds. The molar ratio of the urea bond content to the urethane bond content is usually from 100/0 to 10/90, and preferably from 80/20 to 20/80, with a range of 60/40 to 30/70 being even better. If the molar ratio of urea bonds is less than 10%, resistance to photo-offsetting will decrease.

The urea-modified polyester is manufactured by a one-shot method, for example. A polyhydric alcohol (PO) and a polycarboxylic acid (PC) are heated to between 150 and 280° C. in the presence of tetrabutoxy titanate, dibutytin oxide, or another known esterification catalyst, and any water that is produced is distilled off while reducing the pressure as needed, to obtain a polyester having hydroxyl groups. Then, this is reacted with a polyisocyanate (PIC) at between 40 and 140° C. to obtain a polyester prepolymer (A) having isocyanate groups. This product (A) is further reacted with an amine (B) at between 0 and 140° C. to obtain a urea-modified polyester.

A solvent can be used as needed in reacting the PIC, and in reacting A and B. Examples of solvents that can be used include aromatic solvents (such as toluene and xylene), ketones (such as acetone, methyl ethyl ketone, and methyl isobutyl ketone), esters (such as ethyl acetate), amides (such as dimethylformamide and dimethylacetamide), ethers (such as tetrahydrofuran), and other such solvents that are inert with respect to isocyanates (PIC).

Also, in the crosslinking and/or extension reaction of the polyester prepolymer (A) and the amine (B), a reaction stopper can be used as needed to adjust the molecular weight of the urea-modified polyester thus obtained. Examples of reaction stoppers include monoamines (such as diethylamine, dibutylamine, butylamine, and laurylamine), and the products of blocking these (ketimine compounds).

The weight average molecular weight of the urea-modified polyester is usually at least 10,000, and preferably from 20,000 to 10,000,000, with a range of 30,000 to 1,000,000 being even better. Photo-offsetting resistance will be worse if the weight is less than 10,000. There are no particular restrictions on the number average molecular weight of the urea-modified polyester and so forth when the above-mentioned unmodified polyester is used, but the number average molecular weight should be adjusted so as to facilitating attaining the above-mentioned weight average molecular weight. When a urea-modified polyester is used alone, its number average molecular weight is usually from 2000 to 15,000, and preferably from 2000 to 10,000, with a range of 2000 to 8000 being even better. Exceeding 20,000 will adversely affect low-temperature fixability, as well as gloss when a full-color apparatus is used.

Since using a combination of an unmodified polyester with a urea-modified polyester improve low-temperature fixability, as well as gloss when a full-color apparatus is used, this is preferable to using a urea-modified polyester alone. The unmodified polyester may include a polyester that has been modified with chemical bonds other than urea bonds.

In terms of low-temperature fixability and photo-offsetting resistance, it is preferable for the unmodified polyester and the urea-modified polyester to be at least partially miscible. It is therefore preferable for the unmodified polyester and the urea-modified polyester to have similar compositions.

The weight ratio between the unmodified polyester and the urea-modified polyester is usually from 20/80 to 95/5, and preferably from 70/30 to 95/5, with a range of 75/25 to 95/5 being even better, and a range of 80/20 to 93/7 being particularly favorable. Photo-offsetting resistance will suffer if the weight ratio of the urea-modified polyester is less than 5%, and this is also disadvantageous in terms of both how long heat resistance lasts and low-temperature fixability.

The glass transition point (Tg) of a binder resin containing an unmodified polyester and a urea-modified polyester is usually from 45 to 65° C., and preferably from 45 to 60° C. The heat resistance of the toner will suffer below 45° C., but low-temperature fixability will be inadequate if 65° C. is exceeded.

Also, since the urea-modified polyester tends to be present on the surface of the resulting toner matrix particles, its heat resistance tends to last longer, even though the glass transition point is lower, than with a conventional polyester-based toner.

Known substances can be used here for colorants, charge control agents, parting agents, and so on.

Next, the method for manufacturing the toner will be described. A preferable manufacturing method will be given here, but the present invention is not limited to this.

Toner Manufacturing Method

1) Produce a toner material liquid in which a colorant, unmodified polyester, polyester prepolymer having an isocyanate group, and parting agent are dispersed in an organic solvent.

It is preferable for the organic solvent to have a boiling point of less than 100° C. because it will be easier to remove the solvent after the formation of the toner matrix particles. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like can be used, either singly or in combinations of two or more types. Particularly favorable are toluene, xylene, and other such aromatic solvents, and methylene chloride, 1,2-dichloroethane, chloroform, carbon tetrachloride, and other such halogenated hydrocarbons. The amount in which the organic solvent is used is usually 0 to 300 weight parts, and preferably 0 to 100 weight parts, and especially 25 to 70 weight parts, per 100 weight parts of the polyester prepolymer.

2) Emulsify the toner material liquid in an aqueous medium in the presence of a surfactant and resin microparticles.

The aqueous medium may be water alone, or it may contain an alcohol (such as methanol, isopropyl alcohol, or ethylene glycol), dimethylformamide, tetrahydrofuran, a cellosolve (such as methyl cellosolve), a lower ketone (such as acetone or methyl ethyl ketone), or another such organic solvent.

The amount in which the aqueous medium is used is usually 50 to 2000 weight parts, and preferably 100 to 1000 weight parts, per 100 weight parts of the toner material liquid. The dispersion state of the toner material liquid will be poor and toner particles of the required size will not be obtained if the amount is less than 50 weight parts. Exceeding 20000 weight parts is not cost effective.

A surfactant, resin microparticles, or other such dispersant may be added as needed in order to improve dispersal in the aqueous medium.

Examples of surfactants include alkylbenzenesulfonates, α-olefinsulfonates, phosphates, and other such anionic surfactants; alkylamine salts, aminoalcohol fatty acid derivatives, polyamine fatty acid derivatives, imidazoline, and other such amine salt types, or alkyltrimethylammonium salts, dialkyldimethylammonium salts, alkyldimethylbenzylammonium salts, pyridinium salts, alkylisoquinolinium salts, benzetonium chloride, and other such quaternary ammonium salt types of cationic surfactants; fatty acid amide derivatives, polyhydric alcohol derivatives, and other such nonionic surfactants; and alanine, dodecyldi(aminoethyl)glycine, di(octylaminoethyl)glycine, N-alkyl-N,N-dimethylammonium betaine, and other such amphoteric surfactants.

The desired effect can be obtained by using an extremely small amount of a surfactant having a fluoroalkyl group. Examples of surfactants having a fluoroalkyl group that can be used to advantage include $C_2$ to $C_{10}$ fluoroalkylcarboxylic acids and metal salts thereof, disodium perfluorooctanesulfonyl glutamate, sodium 3-[ω-fluoroalkyl($C_6$–$C_{11}$)oxy]-1-alkyl ($C_3$–$C_4$) sulfonate, sodium 3-[ω-fluoroalkyl ($C_6$–$C_8$)-N-ethylamino]-1-propanesulfonate, fluoroalkyl ($C_{11}$–$C_{20}$)carboxylic acids and metal salts thereof, perfluoroalkyl($C_7$–$C_{13}$)carboxylic acids and metal salts thereof, perfluoroalkyl($C_4$–$C_{12}$)sulfonic acid and metal salts thereof, perfluorooctanesulfonic acid diethanolamide, N-propyl-N-(2-hydroxyethyl)perfluorooctanesulfonamide, perfluoroalkyl($C_6$–$C_{10}$)sulfonamide propyltrimethylammonium salts, perfluoroalkyl($C_6$–$C_{10}$)-N-ethylsulfonyl glycine salts, and monoperfluoroalkyl($C_6$–$C_{16}$)ethylphosphoric esters.

Examples of trade names include Surflon S-111, S-112, and S-113 (made by Asahi Glass), Fluorad FC-93, FC-95, FC-98, and FC-129 (made by Sumitomo 3M), Unidyne DS-101 and DS-102 (made by Daikin Industries), Megafac F-110, F-120, F-113, F-191, F-812, and F-833 (made by Dainippon Ink & Chemicals), Ektop [uncertain spelling] EF-102, 103, 104, 105, 112, 123A, 123B, 306A, 501, 201, and 204 (made by Tohkem Products), and Ftergent F-100 and F150 (made by Neos).

Examples of cationic surfactants include aliphatic primary, secondary, or secondary amino acids having a fluoroalkyl group, perfluoroalkyl($C_6$–$C_{10}$)sulfonamide propyltrimethylammonium salts and other such aliphatic quaternary ammonium salts, benzalkonium salts, benzetonium chloride, pyridinium salts, and imidazolium salts; trade names include Surflon S-121 (made by Asahi Glass), Fluorad FC-135 (made by Sumitomo 3M), Unidyne Ds-202 (made by Daikin Industries), Megafac F-150 and F-824 (made by Dainippon Ink & Chemicals), Ektop EF-132 (made by Tohkem Products), and Ftergent F-300 (made by Neos).

The resin microparticles are added in order to stabilize the toner matrix particles formed in the aqueous medium. Therefore, it is preferable for these microparticles to be added such that the coverage on the surface of the toner matrix particles will be between 10 and 90%. Examples include methyl polymethacrylate microparticles of 1 μm and 3 μm, polystyrene microparticles of 0.5 μm and 2 μm, and poly (styrene-acrylonitrile) microparticles of 1 μm; trade names include PB-200H (made by Kao), SGP (made by Soken), and Technopolymer SB (made by Sekisui Plastics).

An inorganic compound dispersant such as tricalcium phosphate, calcium carbonate, titanium oxide, colloidal silica, or hydroxyapatite may also be used.

Dispersed droplets may be stabilized with a polymer-based protective colloid, as a dispersant that can be used together with the above-mentioned resin microparticles and inorganic compound dispersants. Examples include acrylic acid, methacrylic acid, α-cyanoacrylic acid, α-cyanomethacrylic acid, itaconic acid, crotonic acid, fumaric acid, maleic acid, maleic anhydride, and other such acids, and hydroxyl-group-containing (meth)acrylic monomers (such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide), vinyl alcohols and ethers with vinyl alcohols (such as vinyl methyl ether, vinyl ethyl ether, and vinyl propyl ether), esters of vinyl alcohols and compounds containing a carboxyl group (such as vinyl acetate, vinyl propionate, and vinyl butyrate), acrylamide, methacrylamide, diacetoneacrylamide, and methylol compounds of these, acrylic acid chloride, methacrylic acid chloride, and other such acid chlorides, vinylpyridine, vinylpyrrolidone, vinylimidazole, ethyleneimine, and other such nitrogen-containing compounds, compounds having heterocyclic rings of these, and other such homopolymers and copolymers, polyoxyethylene, polyoxypropylene, polyoxyethylenealkylamine, polyoxypropylenealkylamine, polyoxyethylenealkylamide, polyoxypropylenealkylamide, polyoxyethylene nonyl phenyl ether, polyoxyethylene lauryl phenyl ether, polyoxyethylene stearyl phenyl ester, polyoxyethylene nonyl phenyl ester, and other such polyoxyethylene-based compounds, and methyl cellulose, hydroxyethyl cellulose, hydroxypropyl cellulose, and other such cellulose derivatives.

There are no particular restrictions on the method of dispersal, but a low-speed shear process, high-speed shear process, friction process, high-pressure jet process, ultrasonic process, or other such known process can be used. Of these, a high-speed shear process is preferred because the dispersed particles can be adjusted to a size of from 2 to 20 μm. When a high-speed shear disperser is used, there are no particular restrictions on the rotational speed, but it is usually from 1000 to 30,000 rpm, and preferably from 5000 to 20,000 rpm. There are no particular restrictions on the dispersal time, but with a batch process, it is usually from 0.1 to 5 minutes. The temperature during dispersal is usually from 0 to 150° C. (under pressure), and preferably from 40 to 98° C.).

3) Simultaneously with the production of an emulsion, add the amine (B) and react with the polyester prepolymer (A) having an isocyanate group.

This reaction crosslinks and/or extends the molecular chains. The reaction duration is selected as dictated by the reactivity between the amine (B) and the isocyanate group structure of the polyester prepolymer (A), but is usually from 10 minutes to 40 hours, and preferably from 2 to 24 hours. The reaction temperature is usually from 0 to 150° C., and preferably from 40 to 98° C. A known catalyst can be used as needed. Specific examples include dibutyltin laurate and dioctyltin laurate.

4) Upon completion of the reaction, remove the organic solvent from the emulsified dispersion (reaction product), and wash and dry the product to obtain toner matrix particles.

To remove the organic solvent, The temperature is raised while the entire system is gradually agitated to a laminar flow state, and the system is vigorously agitated in a specific temperature region, after which the solvent is removed, which produces spindle-shaped toner matrix particles. When a substance that is soluble in acids and alkalies, such as a calcium phosphate, is used as a dispersion stabilizer, the calcium phosphate is dissolved with an acid (such as hydrochloric acid), after which the system is washed with water to remove the calcium phosphate from the toner matrix particles. This removal can also be accomplished by decomposition with an enzyme, for example.

5) Add a charge control agent to the toner matrix particles obtained above, and then externally add inorganic microparticles such as silica microparticles or titanium oxide microparticles to obtain a toner.

In the preparation of a developer by adding external additives and lubricants, these may be added and mixed simultaneously or separately. A standard powder mixer can be used to mix the external additives and so forth, but it is preferable for the mixer to be jacketed, for example, so that the internal temperature can be regulated. Examples of mixing equipment that can be used include a V-mixer, rocking mixer, Lödige mixer, Nauta mixer, and Henschel mixer. The mixing conditions, such as the rotational speed, tumbling speed, time, and temperature, are preferably varied so that the external additives are embedded, preventing the formation of a lubricant thin film on the surface of the toner.

This allows a toner with a small particle size and a sharp particle size distribution to be obtained with ease. Further, the shape can be varied between spherical and spindle-shaped by vigorously stirring in the process of removing the organic solvent, and this also allows the morphology of the surface to be varied from being smooth to wrinkled.

Inorganic microparticles can be used favorably as external additives for improving flowability or making the toner easier to develop and charge. The use of hydrophobic silica or hydrophobic titanium is particularly favorable. These inorganic microparticles preferably have a primary particle size of 5 mμ to 2 μm, and especially 5 mμ to 500 mμ. The BET specific surface area is preferably from 20 to 500 $m^2/g$. The proportion in which these inorganic microparticles are used is preferably from 0.01 to 5 wt % of the toner, with a range of 0.01 to 2.0 wt % being particularly favorable.

Specific examples of other inorganic microparticles include alumina, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbonate, and silicon nitride. Other examples include polymer microparticles such as polystyrene obtained by soap-free emulsion polymerization, suspension polymerization, or dispersion polymerization, methacrylic ester and acrylic ester copolymers, silicone, benzoguanamine, nylon, and other such polycondensation products, and polymer particles made of thermosetting resins.

If the toner surface is covered with a fluidizer such as this in a surface treatment, there will be less contact between the fixing belt 93 and the press roller 95, so there will be less melt-out of the toner, and furthermore the toner will be more hydrophobic, preventing the flow characteristics and charging characteristics from being diminished even under high humidity. Examples of such surface treatment agents include silane coupling agents, silylation agents, silane coupling agents having fluoroalkyl groups, organotitanate-based coupling agents, aluminum-based coupling agents, silicone oil, and modified silicone oil.

The toner of this example can be mixed with a magnetic carrier and used as a two-component developer. In this case, the concentrations of toner and carrier in the developer are preferably 1 to 10 weight parts toner per 100 weight parts carrier. The toner of this example can also be used as a non-magnetic toner or a one-component magnetic toner in which no carrier is used.

As described above, the present invention provides a fixing apparatus in which the contact surface area between a fixing belt and a heating roller can be reduced without loosening the tension of the fixing belt, so the movement of heat to the fixing belt during warm-up can be suppressed and it takes less time for the heating roller temperature to rise, and to provide an image formation apparatus that makes use of this fixing apparatus, and a toner used therein.

The present invention also provides an image formation apparatus that affords sharp, high-quality images because any low-melting point residual toner adhering to the fixing belt or other members does not readily warm to the temperature at which it would be reverse-transferred to the transfer paper.

Various modifications will become possible for those skilled in the art after receiving the teachings of the present disclosure without departing from the scope thereof.

What is claimed is:

1. A fixing apparatus for fixing toner on a passing recording medium, comprising:

a fixing belt stretched around a plurality of rollers including a heating roller and a fixing roller;

a press roller disposed across from the fixing belt; and wherein the fixing apparatus further comprises adjustment means for adjusting the contact surface area of the fixing belt on the heating roller such that the contact surface area is different during warm-up and during fixing.

2. The fixing apparatus according to claim 1, wherein the adjustment means reduces the contact surface area between the heating roller and the fixing belt by moving the stretching position during warm-up.

3. The fixing apparatus according to claim 2, wherein the adjustment means is an oil coating member for coating the fixing belt surface with oil, and the position where the oil coating member presses on the fixing belt is varied so as to vary the amount of the fixing belt wound onto the heating roller or the fixing roller, and during warm-up the oil coating member is released to reduce the contact surface area.

4. The fixing apparatus according to claim 1, wherein the adjustment means reduces the contact surface area between the fixing belt and the heating roller by moving the fixing belt away from the heating roller during warm-up.

5. The fixing apparatus according to claim 4, wherein the adjustment means reduces the contact surface area between the fixing belt and the heating roller by moving the fixing belt to the outside with a separation member provided on the inside of the fixing belt.

6. The fixing apparatus according to claim 5, wherein the separation member is a rotating body that is driven by the fixing belt.

7. The fixing apparatus according to claim 5, wherein the separation member is composed of a heat-resistant resin or rubber and is inserted between the heating roller and the fixing belt during warm-up.

8. The fixing apparatus according to claim 5, wherein the separation member forms a pair with the tension roller of the fixing belt, and has switching means for switching the position of these.

9. The fixing apparatus according to claim 8, wherein the switching means switches when a set temperature is detected by temperature sensing means disposed on the heating roller.

10. An image formation apparatus, comprising:

an image support on which a latent image is formed;

a charging apparatus for uniformly charging the image support surface;

an exposure apparatus which writes a latent image by exposure on the image support surface which is charged, on the basis of the image data;

a developing apparatus for producing a visible image by supplying toner to the latent image formed on the image support surface;

a cleaning apparatus for cleaning the image support surface;

a transfer apparatus for transferring the visible image on the image support surface to a recording medium, either directly or after first transferring to an intermediate transfer medium; and a fixing apparatus for fixing the toner image on the recording medium, wherein said fixing apparatus for fixing toner on a passing recording medium comprises a fixing belt stretched around a plurality of rollers including a heating roller and a fixing roller, a press roller disposed across from the fixing belt, a tension roller for applying tension to the fixing belt, and adjustment means for adjusting the contact surface area of the fixing belt on the heating roller as a function of the temperature of the heating roller.

11. The image formation apparatus according to claim 10, wherein said image formation apparatus makes use of a toner whose weight average particle size is 10 μm or less, and whose ratio of weight average particle size to number average particle size (degree of dispersion) is within the range of 1.00 to 1.40.

12. The image formation apparatus according to claim 10, wherein said image formation apparatus makes use of a toner whose average circularity is within the range of 0.93 to 1.00.

13. The image formation apparatus according to claim 10, wherein said image formation apparatus makes use of a toner that has a substantially spherical external shape, whose ratio of major axis to minor axis (r1/r2) is within the range of 0.5 to 1.0, whose ratio of thickness to minor axis (r3/r2) is within the range of 0.7 to 1.0, and which satisfies the relationship, major axis r1≧minor axis r2≧thickness r3.

14. The image formation apparatus according to claim 10, wherein said image formation apparatus makes use of a toner obtained by subjecting a toner composition containing at least a polyester prepolymer including a nitrogen atom and having a functional group, a polyester, a colorant, and a parting agent to crosslinking and/or an extension reaction in an aqueous medium and in the presence of resin microparticles.

15. The image formation apparatus according to claim 10, wherein the adjustment means reduces the contact surface area between the heating roller and the fixing belt by moving the stretching position during warm-up.

16. The image formation apparatus according to claim 15, wherein the adjustment means is an oil coating member for coating the fixing belt surface with oil, and the position where the oil coating member presses on the fixing belt is varied so as to vary the amount of the fixing belt wound onto the heating roller or the fixing roller, and during warm-up the oil coating member is released to reduce the contact surface area.

17. The image formation apparatus according to claim 10, wherein the adjustment means reduces the contact surface area between the fixing belt and the heating roller by moving the fixing belt away from the heating roller during warm-up.

18. The image formation apparatus according to claim 17, wherein the adjustment means reduces the contact surface area between the fixing belt and the heating roller by moving the fixing belt to the outside with a separation member provided on the inside of the fixing belt.

19. The image formation apparatus according to claim 18, wherein the separation member is a rotating body that is driven by the fixing belt.

20. The image formation apparatus according to claim 18, wherein the separation member is composed of a heat-resistant resin or rubber and is inserted between the heating roller and the fixing belt during warm-up.

21. The image formation apparatus according to claim 18, wherein the separation member forms a pair with the tension roller of the fixing belt, and has switching means for switching the position of these.

22. The image formation apparatus according to claim 21, wherein the switching means switches when a set temperature is detected by temperature sensing means disposed on the heating roller.

23. A toner used in an image formation apparatus, whose weight average particle size is 10 μm or less, and whose ratio of weight average particle size to number average particle size (degree of dispersion) is within the range of 1.00 to 1.40, said image formation apparatus comprising:

an image support on which a latent image is formed;

a charging apparatus for uniformly charging the image support surface;

an exposure apparatus which writes a latent image by exposure on the image support surface which is charged, on the basis of the image data;

a developing apparatus for producing a visible image by supplying toner to the latent image formed on the image support surface;

a cleaning apparatus for cleaning the image support surface;

a transfer apparatus for transferring the visible image on the image support surface to a recording medium, either directly or after first transferring to an intermediate transfer medium; and a fixing apparatus for fixing the toner image on the recording medium, wherein said fixing apparatus for fixing toner on a passing recording medium comprises a fixing belt stretched around a plurality of rollers including a heating roller and a fixing roller, a press roller disposed across from the fixing belt, a tension roller for applying tension to the fixing belt, and adjustment means for adjusting the contact surface area of the fixing belt on the heating roller as a function of the temperature of the heating roller.

24. The toner according to claim 23, wherein said toner has an average circularity within the range of 0.93 to 1.00.

25. The toner according to claim 23, wherein said toner has a substantially spherical external shape, has a ratio of major axis to minor axis (r1/r2) that is within the range of 0.5 to 1.0, has a ratio of thickness to minor axis (r3/r2) that is within the range of 0.7 to 1.0, and satisfies the relationship, major axis r1≧minor axis r2≧thickness r3.

26. The toner according to claim 23, wherein said toner is obtained by subjecting a toner composition containing at least a polyester prepolymer including a nitrogen atom and having a functional group, a polyester, a colorant, and a parting agent to crosslinking and/or an extension reaction in an aqueous medium and in the presence of resin microparticles.

* * * * *